US007484619B2

(12) United States Patent
Boriani et al.

(10) Patent No.: US 7,484,619 B2
(45) Date of Patent: Feb. 3, 2009

(54) CIGARETTE BOX WITH HINGED LID

(75) Inventors: Silvano Boriani, Bologna (IT); Alberto Franchini, Monteveglio (IT); Fiorenzo Draghetti, Medicina (IT)

(73) Assignee: GD S.p.A., Bologna (IT)

( * ) Notice: Subject to any disclaimer, the term of this patent is extended or adjusted under 35 U.S.C. 154(b) by 251 days.

(21) Appl. No.: 10/432,161

(22) PCT Filed: Nov. 15, 2001

(86) PCT No.: PCT/IB01/02160

§ 371 (c)(1),
(2), (4) Date: May 20, 2003

(87) PCT Pub. No.: WO02/40379

PCT Pub. Date: May 23, 2002

(65) Prior Publication Data

US 2004/0035722 A1 Feb. 26, 2004

(30) Foreign Application Priority Data

Nov. 20, 2000 (IT) ..... BO2000A0676

(51) Int. Cl.
*B65D 85/10* (2006.01)

(52) U.S. Cl. ..... 206/265; 206/273

(58) Field of Classification Search ..... 206/259, 206/265, 268, 271, 273, 261, 266
See application file for complete search history.

(56) References Cited

U.S. PATENT DOCUMENTS 3,039,671 A * 6/1962 Efthem ..... 229/120.03
3,708,108 A * 1/1973 Rosenburg, Jr. ..... 229/225
3,944,066 A 3/1976 Niepmann
4,726,471 A * 2/1988 Whately et al. ..... 206/554
5,036,982 A * 8/1991 Aston ..... 229/225
5,161,733 A * 11/1992 Latif ..... 229/225
5,277,304 A * 1/1994 Brizzi et al. ..... 206/256
5,513,752 A * 5/1996 Gottlieb ..... 206/387.1
5,645,213 A 7/1997 Focke et al.

(Continued)

FOREIGN PATENT DOCUMENTS

EP 0703160 3/1996

(Continued)

*Primary Examiner*—Jacob K Ackun, Jr.
(74) *Attorney, Agent, or Firm*—Timothy J. Klima

(57) ABSTRACT

A wrapper with a hinged lid for tobacco products presents a front face (7), a rear race (8), two flank faces (9), a top end face (10) and a bottom end face (11), and comprises a container (13), a lid (15) hinged to the container along a crease lid (16), and a reinforcing frame (25). The wrapper (1) is fashioned from a flat diecut blank (37) comprising a central panel (41), two lateral panels (42) flanking the central panel (41) and an end panel (43), all aligned along a first axis (38), also an appendage (45) aligned with the central panel (41) along a second axis (39) perpendicular to the first axis (38), connected to one end of the central panel (41) and destined lo provide the lid (15). The frame (25) is incorporated directly into the blank (37), created by a process of deformation that involves selectively embossing portions (17*a*, 19*a*) of the front (17) and the flanks (19) of the container (13).

19 Claims, 9 Drawing Sheets

U.S. PATENT DOCUMENTS

| | | | | |
|---|---|---|---|---|
| 5,749,462 | A * | 5/1998 | Houghton | 206/268 |
| 6,370,846 | B1 * | 4/2002 | Schoch et al. | 53/456 |
| 6,742,651 | B1 * | 6/2004 | Focke et al. | 206/268 |
| 6,742,652 | B1 * | 6/2004 | Focke et al. | 206/268 |
| 6,923,315 | B2 * | 8/2005 | Lo Duca | 206/232 |
| 6,929,121 | B2 * | 8/2005 | Boriani et al. | 206/273 |
| 2006/0054518 | A1 * | 3/2006 | Focke et al. | 206/273 |

FOREIGN PATENT DOCUMENTS

| | | |
|---|---|---|
| FR | 2254493 | 7/1975 |
| FR | 2662664 | 12/1991 |
| GB | 819206 | 9/1959 |
| GB | 2301581 | 12/1996 |
| WO | 9946184 | 9/1999 |

* cited by examiner

CIGARETTE BOX WITH HINGED LID

This application is the National Phase of International Application PCT/IB01/02160 filed Nov. 15, 2001 which designated the U.S. and that International Application was published under PCT Article 21 (2 ) in English.

TECHNICAL FIELD

The present invention relates to a rigid wrapper with a hinged lid for tobacco products.

BACKGROUND ART

In the following specification, the term 'rigid wrapper' can be taken to mean both a carton containing a plurality of packets of cigarettes, and a single packet containing a group of cigarettes or tobacco products in general.

Generally considered, rigid wrappers of the type in question with a hinged lid are box-like wrappers of rectangular parallelepiped shape designed, in the case of a carton, to accommodate several packets of cigarettes assembled into a group, and in the case of the single packet, to accommodate an ordered group of cigarettes enveloped by an inner wrapper normally of metal foil paper.

The rigid wrapper comprises a container of cupped embodiment surmounted by a similarly cupped lid hingedly attached to a rear edge of the container and rotatable thus between positions in which the container is open and shut, respectively. Such a wrapper will normally present a top face, a bottom face, a rear face appearing as a continuous panel divided into two parts by a transverse hinge crease along which the lid is connected to the container, also a front face composed of two distinct portions coinciding respectively with the front of the container and the front of the lid, and two flank faces each composed of two distinct portions coinciding respectively with a flank of the container and a flank of the lid.

The container and the lid are fashioned typically by bending a single flat diecut blank of paperboard or similar material to the requisite shape.

Rigid wrappers of the type thus outlined are provided usually with a reinforcing frame also of paperboard or similar material, part of which is positioned internally of the container and disposed in contact with the relative inside faces of the front and flanks. The portion of the frame that projects from the container functions essentially as a supporting and restraining element for the lid when in the closed position.

Rigid wrappers of this type are manufactured conventionally by associating the groups of cigarettes, enveloped in their inner wrappers, with respective frames cut separately from a continuous strip of paperboard material other than the blank used to fashion the rigid wrapper, or alternatively by utilizing blanks with the frame incorporated.

In the latter instance, in particular, the prior art embraces the use of a flat diecut blank presenting a central panel that corresponds to the front of the rigid wrapper fashioned from the blank, and a frame associated with one end of this same panel by way of an intermediate panel, or alternatively, the frame can be attached at two points to the ends of two lateral panels corresponding to the flank faces of the rigid wrapper. A frame of this type is folded double during the process of erecting the wrapper, and fixed to the inside face of the central panel.

In the event that the frame is cut from a separate strip of paperboard as aforementioned and then united with the group of cigarettes, the packer machine must necessarily be equipped with two wrapping lines, one for the wrappers and one for the frames, synchronized in operation one with the other. In the examples mentioned previously, where the frame is incorporated as an integral part of the wrapper blank, the blank will tend to be somewhat complex and costly in terms of the quantity of wrapping material consumed, and moreover the packer machine must be equipped with a dedicated unit for folding the frame double against the central panel of the blank.

The object of the present invention is to provide a rigid wrapper with a hinged lid suitable for cartons and for packets of cigarettes, such as will be unaffected by the drawbacks described above.

DISCLOSURE OF THE INVENTION

The stated object is realized according to the present invention in a wrapper of rigid type with a hinged lid for tobacco products, substantially parallelepiped in shape and referable to a predominating longitudinal axis, with a front face, a rear face, two flank faces, a top end face and a bottom end face, comprising a container and a lid hinged together along a hinge line, also a reinforcing frame, and fashioned from a flat diecut blank, characterized in that the blank comprises a central panel, two lateral panels flanking the central panel and an end panel connected to the central panel by way of one of the lateral panels, all of which aligned along a first axis, also an appendage aligned with the central panel along a second axis perpendicular to the first, connected to the central panel and destined to form the lid, and in that the reinforcing frame is afforded by predetermined portions of the end panel and of the lateral panels.

The invention will now be described in detail, by way of example, with the aid of the accompanying drawings, in which.

Figure 1:
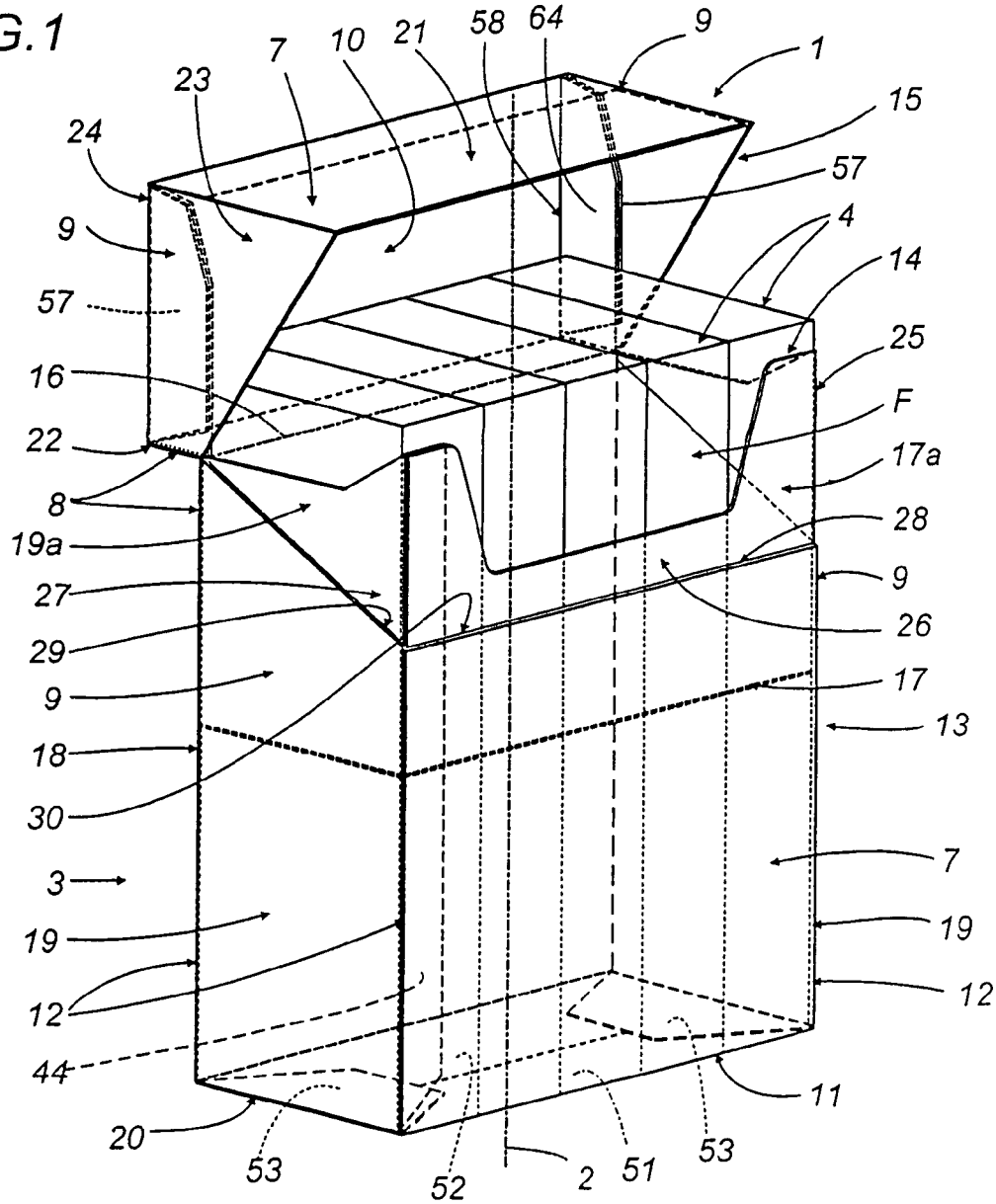
FIGS. 1 and 2 illustrate a first embodiment of the rigid wrapper according to the present invention, viewed schematically and in perspective.

With reference to FIGS. 1, 2, 4, 6 and 8 of the drawings, 1 denotes a wrapper of the rigid type having a hinged lid, which appears as a substantially rectangular parallelepiped referable to a predominating longitudinal axis 2. In the examples of FIGS. 1, 4, 6 and 8, the wrapper 1 functions as a carton 3 serving to accommodate a group of packets 4 of cigarettes arranged in two rows F of five packets each, disposed in contact one with the next, and in the example of FIG. 2, as a packet 4 designed to accommodate a group of cigarettes 5 enveloped by an inner wrapper 6 of metal foil paper.

More particularly, the wrapper 1 presents a front face 7, a rear face 8, two side or flank faces 9, a top end face 10 and a bottom end face 11. The front face 7, rear faces 8 and flank faces 9 are joined one to the next by respective sharp corner edges 12 extending parallel to the longitudinal axis 2.

Figure 8:
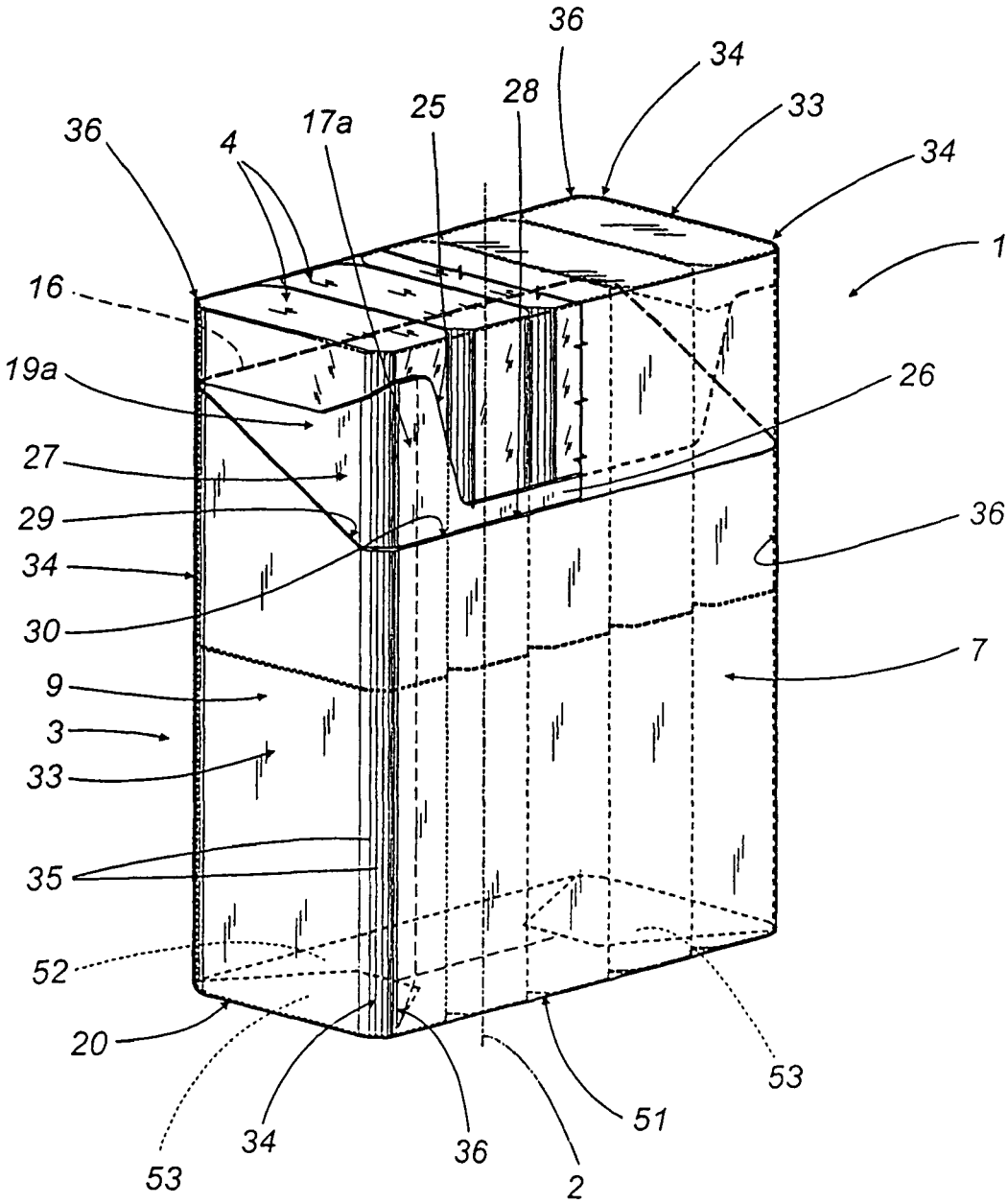

The wrapper 1 comprises a container 13 affording an open top end 14, surmounted by a lid 15 hinged to the container 13 along a relative hinge line 16 and rotatable thus between an open position (illustrated in FIGS. 1, 2, 4 and 6) and a position in which the top end 14 is closed (illustrated in FIG. 8).

The container 13 presents a front 17 and a back 18, mutually opposed and parallel, two mutually opposed and parallel flanks 19 perpendicular to the front and back 17 and 18, and a bottom 20 coinciding with the bottom end face 11 of the wrapper 1.

The lid 15 presents a front 21 and a back 22, two flanks 23, and a top 24 coinciding with the top end face 10 of the wrapper 1.

The container 13 incorporates a frame 25 created by deforming the front 17 and the flanks 19, and more exactly by embossing a predetermined portion 17*a* of the front 17, delimited uppermost by an edge of U profile, and corresponding predetermined portions 19*a* of the flanks 19. These predetermined portions 17*a* and 19*a* are identifiable thus as embossed areas, denoted 26 and 27 respectively, delimited by respective embossed lines 28 and 29 which in turn combine to establish an edge 30 receding from the planes occupied by the front 17 and flanks 19 and affording a lip against which the lid 15 locates when in the closed position.

Figure 2:
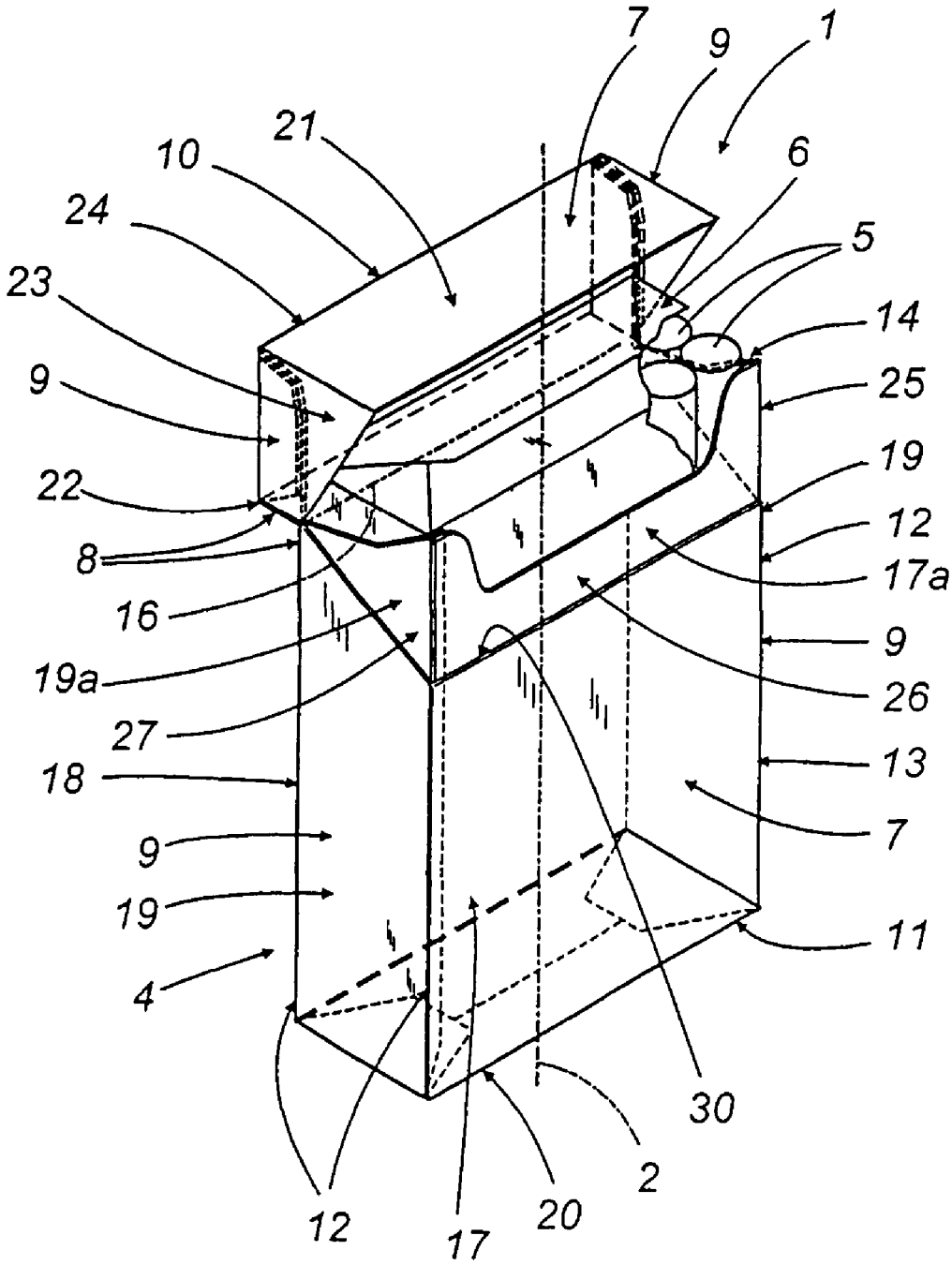
Figure 4:
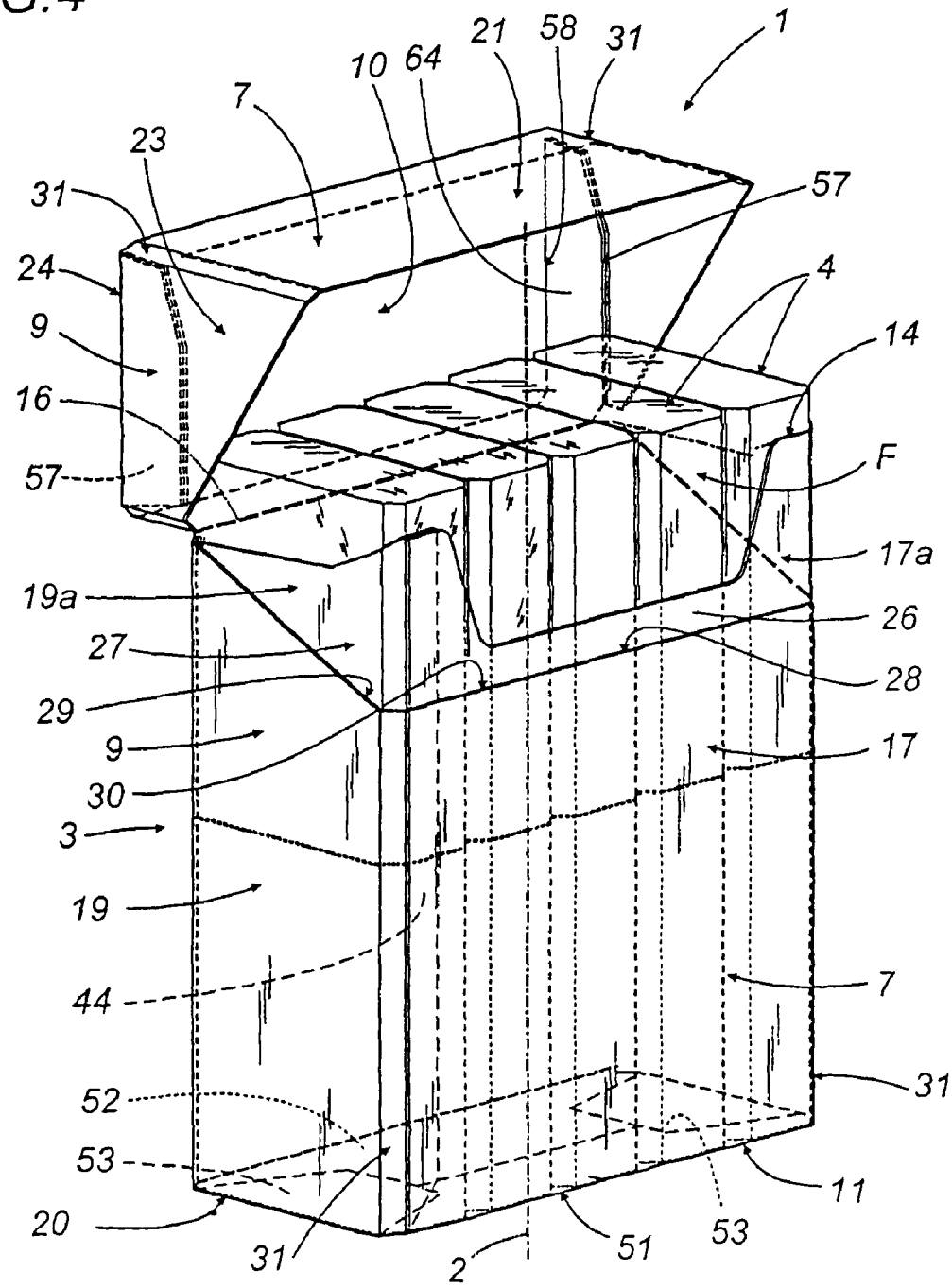
FIGS. 4, 6 and 8 illustrate three further embodiments of the rigid wrapper according to the present invention, viewed schematically and in perspective.
Figure 6:
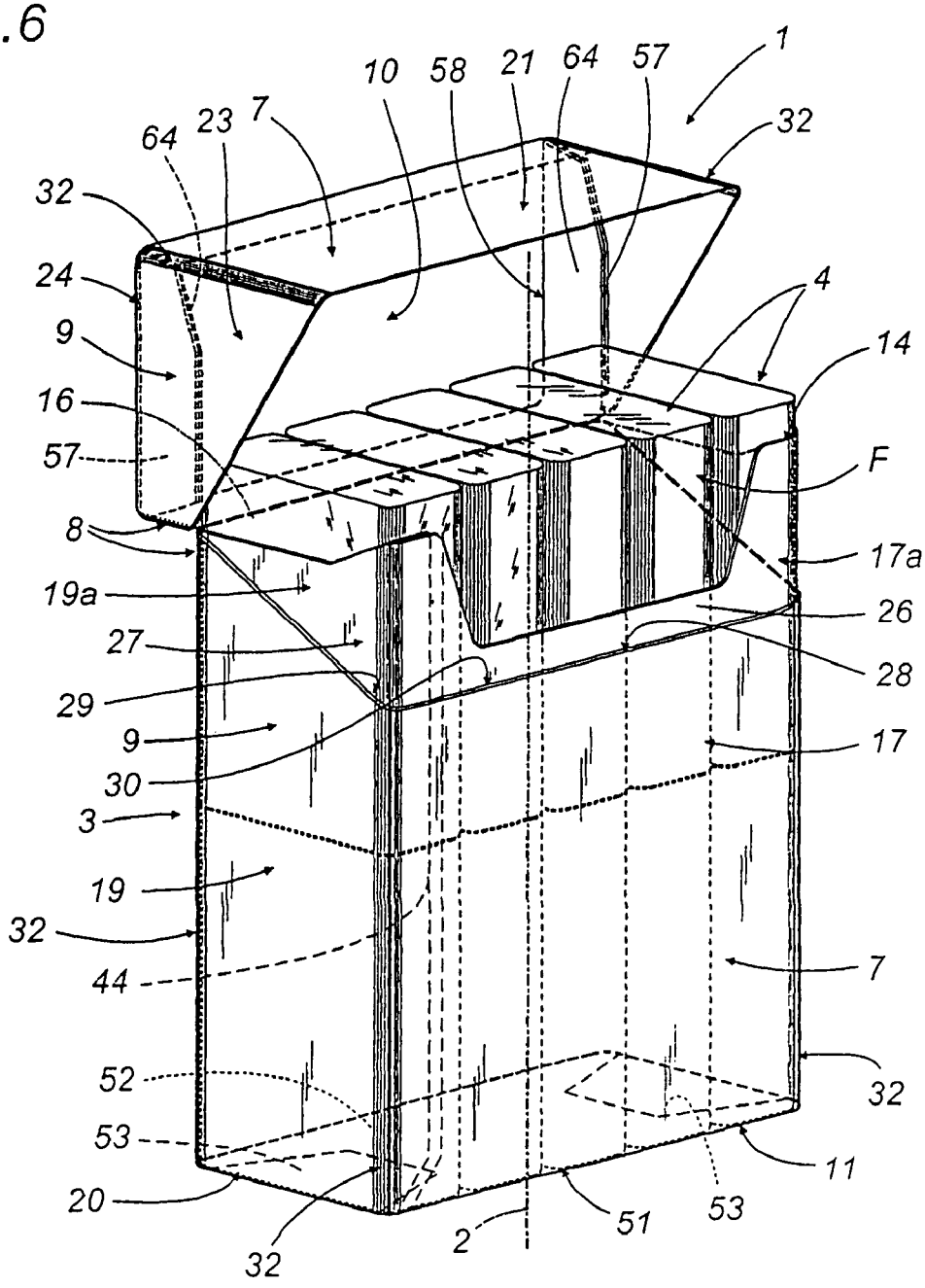

In the example of FIGS. 1 and 2, the wrappers 1 are fashioned with the longitudinal faces 7, 8 and 9 joined along sharp corner edges 12 and the carton 3 of FIG. 1 is designed to accommodate packets 4 likewise having sharp corner edges 12, whereas in the example of FIG. 4 the faces 7, 8 and 9 of the wrapper 1 are joined along bevelled longitudinal corner edges 31 and the carton 3 is designed to accommodate packets 4 with bevelled corner edges 31, and in the example of FIG. 6, the faces 7, 8 and 9 of the wrapper 1 are joined along rounded longitudinal corner edges 32 and the carton 3 is designed to accommodate packets 4 with rounded corner edges 32.

In the example of FIG. 8, finally, the side or flank faces 9 of the wrapper 1 are disposed mutually parallel and appear essentially convex, extending substantially perpendicular to the front and rear faces 7 and 8. Each flank face 9 presents a flat central portion 33 and two longitudinally disposed lateral bands 34, rendered pliable by internal crease lines 35, which are joined to the respective front face 7 and rear face 8 along relative sharp corner edges 36.

In particular, the carton 3 of FIG. 8 is designed to accommodate packets 4 exhibiting the same basic geometry, of the type disclosed in patent application PCT/IT99/00222, to which reference may be made for a full description.

Referring to FIGS. 3, 5, 7 and 9, the wrapper 1 is erected from a flat diecut blank 37 substantially of L outline referable to a first transverse axis 38, and to a second longitudinal axis 39 extending parallel to the axis 2 of the wrapper 1. In each case the blank 37 comprises a main portion 40, destined to provide the container 13 of the wrapper 1, which is aligned on the first transverse axis 38 and includes a plurality of sections ranged along the selfsame first axis 38, namely a central panel 41, two lateral panels 42 disposed one on either side of the central panel 41, an end panel 43 connected to one of the two lateral panels 42 flanking the central panel 41, and an end flap 44 connected to the remaining lateral panel 42. The blank 37 further comprises an appendage 45 connected to the main portion 40 and aligned with the central panel 41 on the second axis 39. The appendage 45 in question, which is destined to provide the lid 15, comprises a first panel 46, a second panel 47 and a reinforcing flap 48.

The aforementioned main portion 40 presents four first precreased fold areas 49 disposed transversely to the first axis 38, serving to delimit the central panel 41, which coincides with the rear face 8 or back of the wrapper 1, the lateral panels 42 which coincide with the flanks 19 of the container 13, the end panel 43 which coincides with the front 17 of the container 13 and terminates uppermost in a top edge of U profile, and the end flap 44 which will be breasted with the inside face of the end panel 43 to seal the container 13 laterally. The main portion 40 also presents a first crease line 50 disposed parallel to the transverse axis 38, delimiting a first end fold 51 associated with the end panel 43, a second end fold 52 associated with the central panel 41 and two flaps 53 associated each with a respective lateral panel 42. The second end fold 52 and the flaps 53 will be breasted ultimately with and secured to the inside surface of the first end fold 51, combining with the latter to make up the bottom 11 of the wrapper 1.

The appendage 45 presents second, third and fourth crease lines denoted 54, 55 and 56 respectively, extending parallel to the first crease line 50 on the main portion 40. Of these, the second crease line 54 constitutes the line along which the appendage 45 is joined to the central panel 41 and combines with the third and the fourth crease lines 55 and 56 to delimit the first panel 46 constituting the top end face 10 of the wrapper 1, the second panel 47 constituting the front 21 of the lid 15, and the reinforcing flap 48 which will be folded double and flattened against the inside surface of the front 21.

The first panel 46 of the appendage 45 presents a first pair of lateral flaps 57 associated with the two edges of the panel 46 located on opposite sides of the second axis 39. The flaps 57 are joined to the panel 46 along respective crease lines 58 disposed transversely to the first axis 38, aligned on the aforementioned precreased fold areas 49 separating the central panel 41 from the two lateral panels 42 and extending parallel with the longitudinal second axis 39. Similarly, the second panel 47 of the appendage 45 presents a second pair of lateral flaps 59 delimited by second precreased fold areas 60 extending transversely to the first axis 38 and in alignment with the crease lines 58 mentioned previously.

As illustrated in FIGS. 3, 5, 7 and 9, the central panel 41 of the main portion 40 presents a crease line 61 lying parallel to the first axis 38, occupying a position on the opposite side of the selfsame axis 38 from the first crease line 50, near to the second crease line 54 by way of which the first panel 46 of the appendage 45 is joined to the central panel 41 of the main portion 40, and providing the hinge line 16 along which the lid 15 is connected to the container 13 of the wrapper 1; this further crease line 61 combines with the second crease line 54 to delimit a panel 62 coinciding with the back 22 of the lid 15. The lateral panels 42 exhibit respective cuts 63, each extending from the corresponding end of the hinge crease line 61 across the full width of the panels 42 in such a way as to create two flaps 64 combining with the aforementioned first and second pairs of flaps 57 and 59 to make up the flanks 23 of the lid 15.

The two lateral panels 42, the end panel 43 and the end flap 44 of the main portion 40 are crossed by respective embossed lines denoted 65 in their entirety, departing from the opposite ends of the hinge crease line 61, which comprise two sections 66 extending from the ends of the crease line 61, angled toward the first axis 38 and occupying the two lateral panels 42, also two sections 67 and 68 extending parallel with the first axis 38 and occupying the end flap 44 and the end panel 43, respectively. More exactly, the three sections 66, 67 and 68 in question serve to delimit embossed areas on the lateral panels 42 coinciding with the relative embossed areas 27 of the wrapper 1, hence denoted by the same number 27, and an embossed area on the end panel 43 coinciding likewise with the relative embossed area 26 of the wrapper 1, hence denoted by the same number 26; these embossed areas 26 and 27 combine with an embossed area at the top of the end flap 44 to create the reinforcing frame 25.

Figure 3:
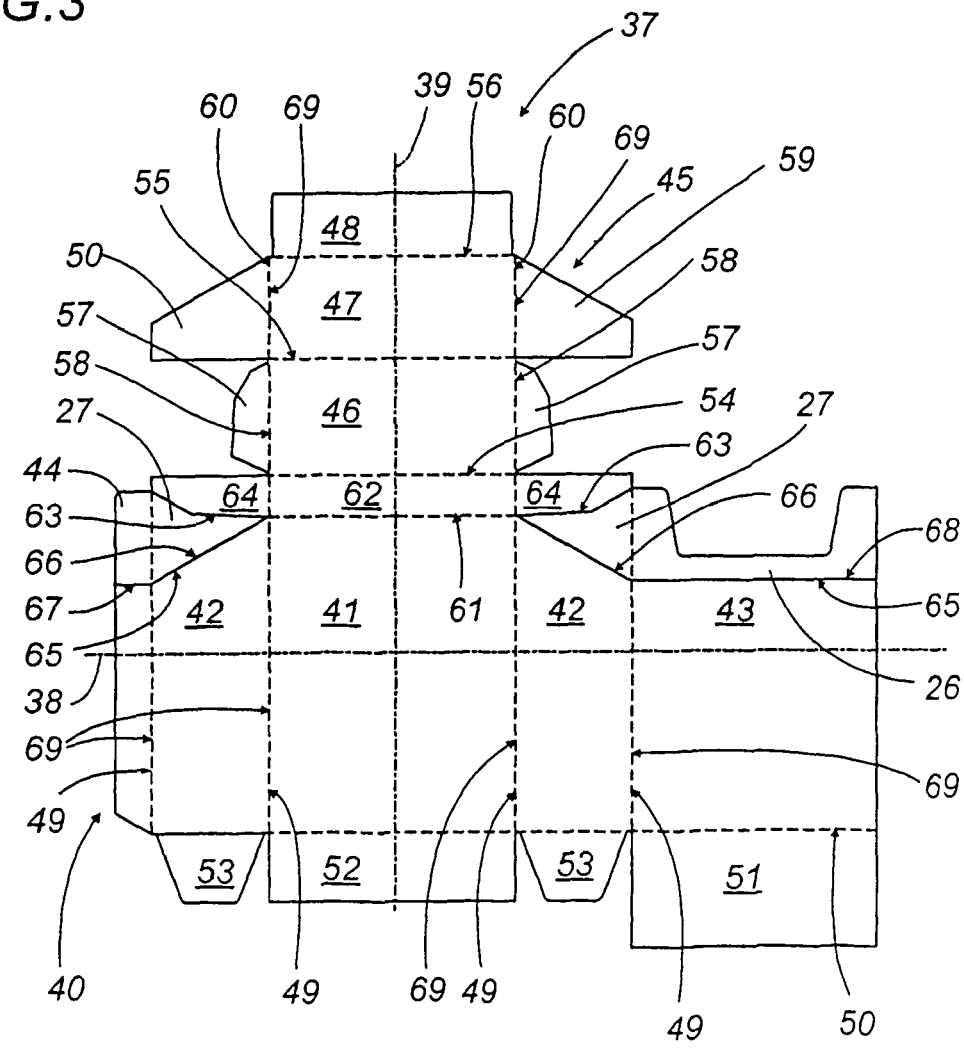
FIG. 3 illustrates a flat diecut blank used to fashion the wrappers of FIGS. 1 and 2.

In the example of FIG. 3, the blank 37 is used to fashion a wrapper 1 as in FIGS. 1 and 2 and the first precreased fold areas 49 consist in respective crease lines 69 appearing as sharp corner edges 12 on the container 13 of the finished wrapper 1.

Similarly, the second precreased fold areas 60 consist in crease lines 69 appearing as sharp corner edges 12 on the lid 15 of the finished wrapper 1.

Accordingly, the first end fold 51 associated with the end panel 43 and the first panel 46 of the appendage 45 both present right angles at the four corners.

Figure 5:
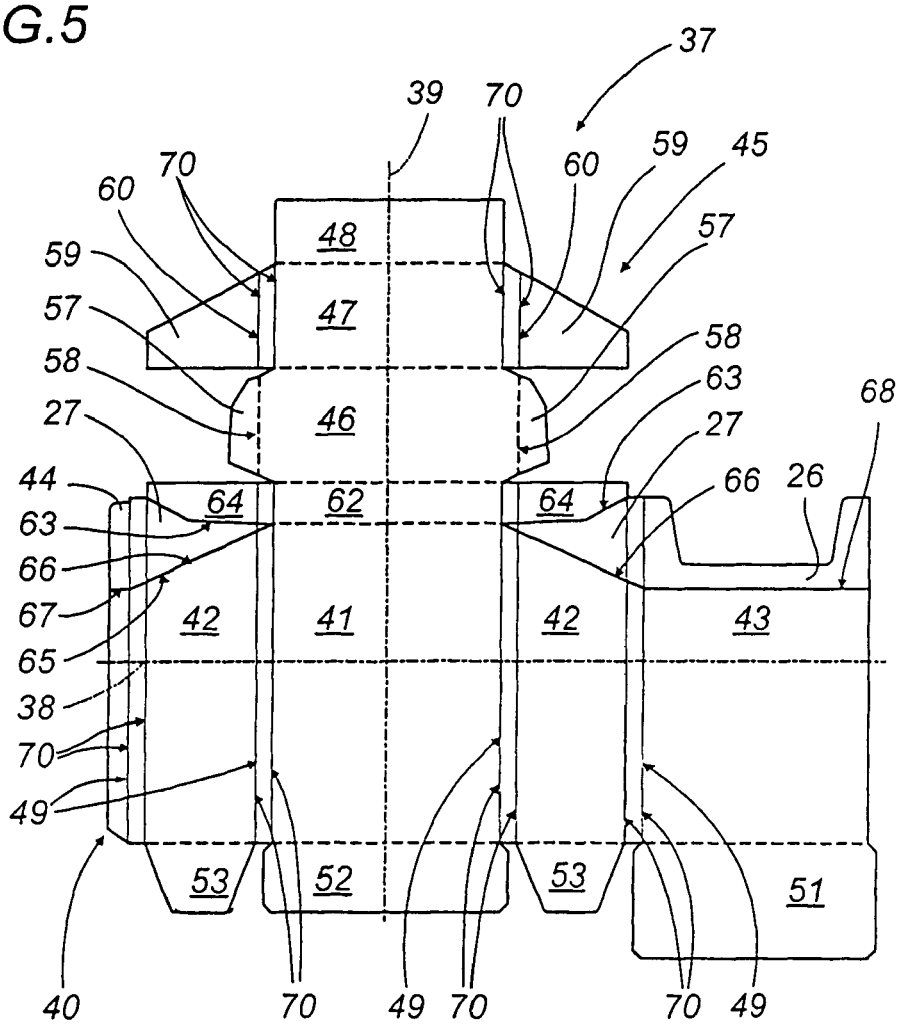
FIGS. 5, 7 and 9 illustrate respective flat diecut blanks used to fashion the wrappers of FIGS. 4, 6 and 8.

In the example of FIG. 5, the blank 37 is used to fashion a wrapper 1 as in FIG. 4 and each of the first precreased fold areas 49 consists in two crease lines 70 extending mutually parallel, separated by a first predetermined distance and generating bevelled corner edges 31 on the container 13 of the finished wrapper 1. Similarly, the second precreased fold areas 60 consist each in a pair of crease lines 70 generating bevelled corner edges 31 on the lid 15 of the finished wrapper 1.

Accordingly, the first end fold 51 associated with the end panel 43, the second end fold 52 and the first panel 46 of the appendage 45 present truncated angles at the four corners.

Figure 7:
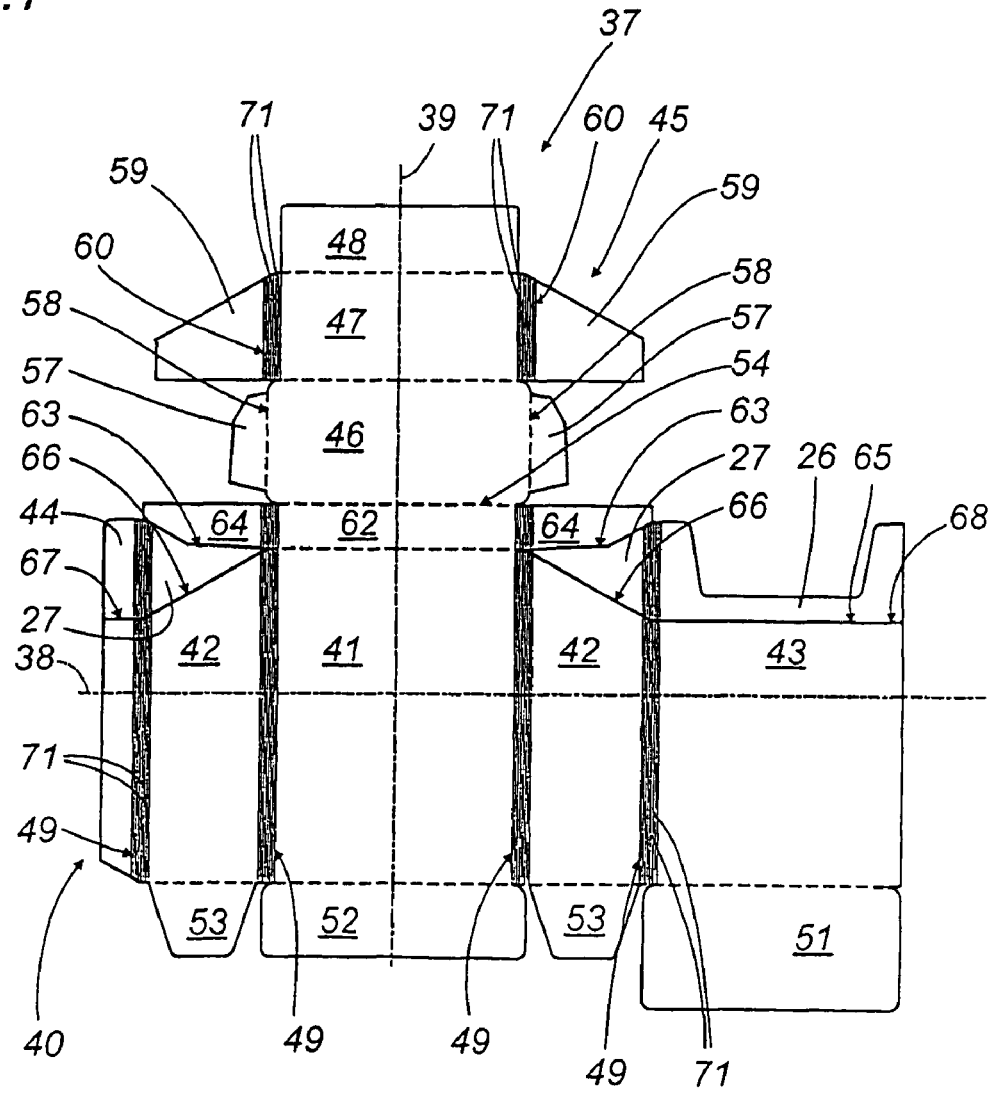

In the example of FIG. 7, the blank 37 is used to fashion a wrapper 1 as in FIG. 6 and each of the first precreased fold areas 49 consists in a plurality of crease lines 71 extending mutually parallel, separated by a second predetermined distance and generating rounded corner edges 32 on the container 13 of the finished wrapper 1. Similarly, the second precreased fold areas 60 consist each in a plurality of crease lines 71 generating rounded corner edges 32 on the lid 15 of the finished wrapper 1.

Accordingly, the first end fold 51 associated with the end panel 43, the second end fold 52 and the first panel 46 of the appendage 45 present rounded angles at the four corners.

Figure 9:
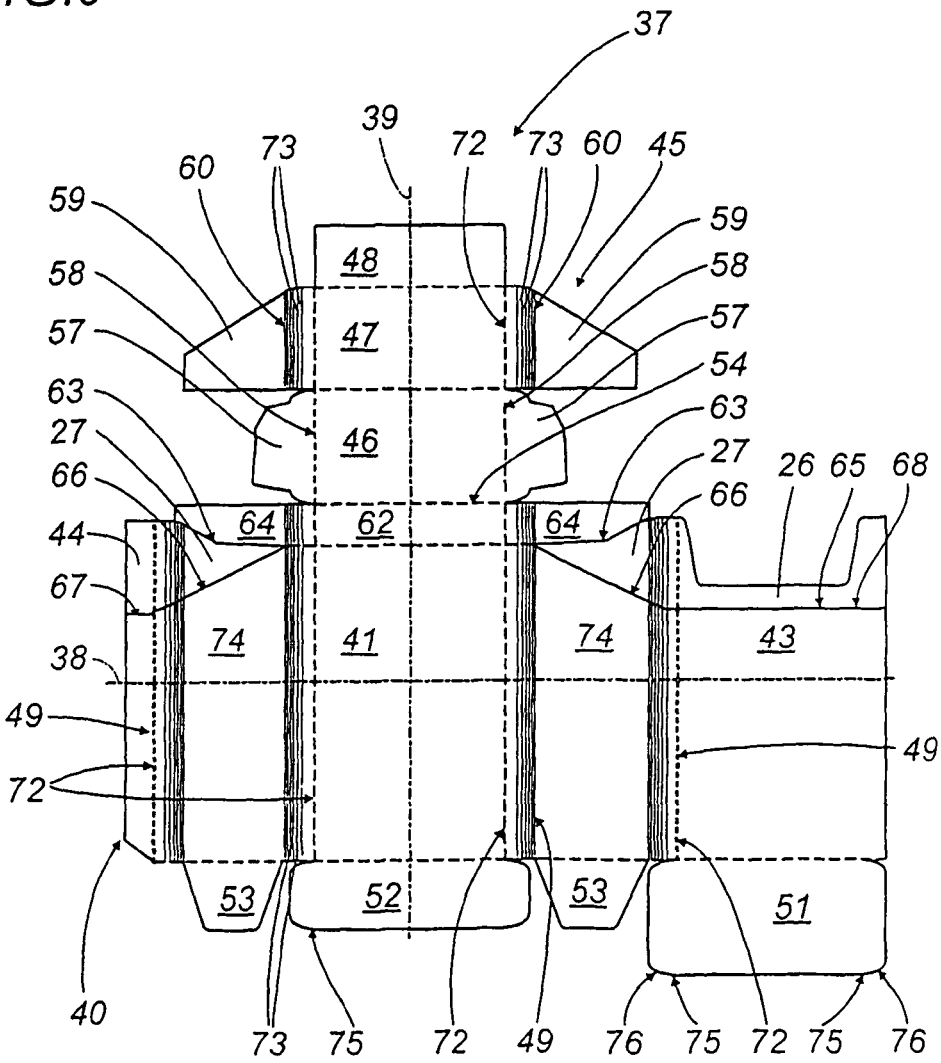

In the example of FIG. 9, each first precreased fold area 49 comprises a crease line 72 positioned to create the sharp corner edge 36 of the wrapper 1 as in FIG. 8, also a plurality of crease lines 73 extending mutually parallel and serving to join a central part 74 of each lateral panel 42 to the relative crease line 72. The sets of crease lines 72 and 73 make up the aforementioned longitudinal lateral bands 34 of the wrapper 1 in FIG. 8. Similarly, the second precreased fold areas 60 consist each in a single crease line 72 and a plurality of crease lines 73 coinciding with a relative lateral band 34 on the lid 15 of the finished wrapper 1.

Accordingly, the first end fold 51 associated with the end panel 43, the second end fold 52 and the first panel 46 of the appendage 45 present angles composed each of a sharp corner 75 and a curved portion 76 which in the finished wrapper 1 will be aligned respectively on the end of a corresponding crease line 72 and on the end of a corresponding plurality of crease lines 73.

It will be appreciated that the wrappers 1 illustrated as cartons 3 in FIGS. 4, 6 and 8 are equally suitable for the manufacture of cigarette packets 4, as in the case of the carton 3 illustrated in FIG. 1 and the relative packet 4 illustrated in FIG. 2.

The Invention Claimed is:

1. A cigarette packet with a hinged lid for tobacco products, substantially parallelepiped in shape and referable to a predominating longitudinal axis, with a front face, a rear face, two lateral faces, a top end face and a bottom end face, comprising a container and a lid hinged together along a hinge line, also a reinforcing frame, and fashioned from a flat diecut blank, wherein the blank comprises a central panel, two lateral panels joined to the central panel and an end panel connected to the central panel by way of one of the lateral panels, all of which are aligned along a first axis, also an appendage aligned with the central panel along a second axis perpendicular to the first axis, connected to the central panel to form the lid, and in that the reinforcing frame is defined by predetermined portions of the end panel and each of the lateral panels, the end panel forming at least a portion of the front face; the packet also comprising a plurality of cigarettes therein.

2. A packet as in claim 1, wherein the predetermined portions comprise respective embossed areas.

3. A packet as in claim 2, wherein at least one longitudinal corner edge of the parallelepiped is a beveled corner edge.

4. A packet as in claim 2, wherein at least one longitudinal corner edge of the parallelepiped is a rounded corner edge.

5. A packet as in claim 2, wherein at least one longitudinal corner edge of the parallelepiped includes a band of curved profile with a concave face directed inward, by which a central part of one of the faces is joined along a sharp corner edge to an adjacent face

6. A packet as in claim 2, wherein the blank comprises a main portion, to provide the container, aligned on the first axis and including four first precreased fold areas disposed transversely to the first axis and serving to delimit the central panel, the lateral panels, the end panel and an end flap connected to one respective lateral panel; a first crease line lying parallel to the first axis and delimiting a first end fold associated with the end panel; also a second end fold associated with the central panel and two flaps associated each with a respective lateral panel, combining with the first and second end folds to form the bottom of the packet ; the appendage including a second, a third and a fourth crease line extending parallel to the first crease line, of which the second crease line marks the join between the appendage and the central panel whilst the third and fourth crease lines define a first panel constituting the top end face of the packet, a second panel constituting the front of the lid, and a reinforcing flap; the first panel of the appendage including a first pair of lateral flaps delimited by respective crease lines disposed transversely to the first axis, the second panel of the appendage including a second pair of lateral flaps delimited by second precreased fold areas extending transversely to the first axis; the central panel of the main portion including a cm-ease line lying parallel to the first axis and functioning as the hinge line; the lateral panels exhibiting respective cuts extending full width from the corresponding opposite ends of the hinge crease line to create respective flaps combining with the first and second pairs of flaps to make up lateral faces of the lid; the lateral panels, the end panel and the end flap of the main portion including respective embossed lines positioned to delimit the embossed areas constituting the frame.

7. A packet as in claim 6, wherein the fast and second precreased fold areas comprise at least one crease line.

8. A packet as in claim 1, embodied as a carton designed to accommodate packets of cigarettes.

9. A packet as in claim 3, wherein the blank comprises a main portion, to provide the container, aligned on the first axis and including four first precreased fold areas disposed transversely to the first axis and serving to delimit the central panel, the lateral panels, the end panel and an end flap connected to one respective lateral panel; a first crease line lying parallel to the first axis and delimiting a first end fold associated with the end panel; also a second end fold associated with the central panel and two flaps associated each with a respective lateral panel, combining with the first and second end folds to form the bottom of the packet; the appendage including a second, a third and a fourth crease line extending parallel to the first crease line, of which the second crease line marks the join between the appendage and the central panel whilst the third and fourth crease lines define a first panel constituting the top end face of the packet, a second panel constituting the front of the lid, and a reinforcing flap; the first panel of the appendage including a first pair of lateral flaps delimited by respective crease lines disposed transversely to the first axis, the second panel of the appendage including a second pair of lateral flaps delimited by second precreased fold areas extending transversely to the first axis; the central panel of the main portion including a crease line lying parallel to the first axis and functioning as the hinge line; the lateral panels exhibiting respective cuts extending full width from the corresponding opposite ends of the hinge crease line to create respective flaps combining with the first and second pairs of flaps to make tip the lateral faces of the lid; the lateral panels, the end panel and the end flap of the main portion including respective embossed lines positioned to delimit the embossed areas constituting the fame.

10. A packet as in claim 4, wherein the blank comprises a main portion, to provide the container, aligned on the first axis and including four first precreased fold areas disposed transversely to the first axis and serving to delimit the central panel, the lateral panels, the end panel and an end flap connected to one respective lateral panel; a first crease line lying parallel to the first axis and delimiting a first end fold associated with the end panel; also a second end fold associated with the central panel and two flaps associated each with a respective lateral panel, combining with the first and second end folds to form the bottom of the packet; the appendage including a second, a third and a fourth crease line extending parallel to the first crease line, of which the second crease line marks the join between the appendage and the central panel whilst die third and fourth crease lines define a first panel constituting the top end face of the packet, a second panel constituting the front of the lid, and a reinforcing flap; the first panel of the appendage including a first pair of lateral flaps delimited by respective crease lines disposed transversely to the first axis, the second panel of the appendage including a second pair lateral flaps delimited by second precreased fold areas extending transversely to the first axis; the central panel of the main portion including a crease line lying parallel to the first axis and functioning as the hinge line; the lateral panels exhibiting respective cuts extending full width from the corresponding opposite ends of the hinge crease line to create respective flaps combining with the first and second pairs of flaps to make up the Lateral faces of the lid; the lateral panels, the end panel and the end flap of the main portion including respective embossed lines positioned to delimit the embossed areas constituting the frame.

11. A packet as in claim 5, wherein the blank comprises a main portion, to provide the container, aligned on the first axis and including four first precreased fold areas disposed transversely to the first axis and serving to delimit the central panel, the lateral panels , the end panel and an end flap connected to one respective lateral panel; a first crease line lying parallel to the first axis and delimiting a first end fold associated with the end panel; also a second end fold associated with the central panel and two flaps associated each with a respective lateral panel, combining with the first and second end folds to form the bottom of the packet; the appendage including a second, a third and a fourth crease line extending parallel to the first crease line, of which the second crease line marks the join between the appendage and the central panel whilst the third and fourth crease tines define a first panel constituting the top end face of the packet, a second panel constituting the front of the lid, and a reinforcing flap; the first panel of the appendage including a first pair of lateral flaps delimited by respective crease lines disposed transversely to the first axis, the second panel of the appendage including a second pair of lateral flaps delimited by second precreased fold areas extending transversely to the first axis; the central panel of the main portion including a crease line lying parallel to the first axis and functioning as the hinge line; the lateral panels exhibiting respective cuts extending full width from the corresponding opposite ends of the hinge crease line to create respective flaps combining with the first and second pairs or flaps to make up the lateral faces of the lid; the lateral panels, the end panel and the end flap of the main portion including respective embossed lines positioned to delimit the embossed areas constituting the frame.

12. A packet as in claim 2, wherein portions of the respective embossed areas are limited by respective embossed lines which form a lip against which the lid Locates when in a closed position.

13. A packet as in claim 1, wherein the reinforcing frame has an exposed portion greater in area than an overlapped portion.

14. A packet as in claim 9, wherein at least one of the first and second precreased fold areas comprises two crease lines separated one from the other by a predetermined distance.

15. A packet as in claim 10, wherein at least one of the first and second precreased fold areas comprises a plurality of crease lines extending mutually parallel and separated one from another by a predetermined distance.

16. A packet as in claim 11, wherein the first and second precreased fold areas comprise a crease line bordering at least one of the panels and at least one lateral flap of the second pair, each of which exhibits a plain central part and a lateral part rendered pliable by crease lines extending transversely to the first axis.

17. A carton with a hinged lid For tobacco products, substantially parallelepiped in shape and referable to a predominating longitudinal axis, with a front face, a rear face, two lateral faces, a top end face and a bottom end face, comprising a container and a lid hinged together along a hinge line, also a reinforcing frame, and fashioned from a flat diecut blank, wherein die blank comprises a central panel, two lateral panels joined to the central panel and an end panel connected to the central panel by way of one of the lateral panels, all of which aligned along a first axis, also an appendage aligned with the central panel along a second axis perpendicular to the first axis, connected to the central panel and to form the lid, and in that the reinforcing frame is defined by predetermined portions of the end panel and each of the lateral panels; the carton containing a plurality of cigarette packets.

18. A wrapper of rigid type with a hinged lid for tobacco products, substantially parallelepiped in shape and referable to a predominating longitudinal axis, with a front face, a rear face, two lateral faces, a top end face and a bottom end face, comprising a container and a lid hinged together along a hinge line, also a reinforcing frame, the container comprising a front wall; the wrapper being fashioned from a flat diecut blank, wherein the blank comprises a central panel, two lateral panels joined to the central panel and an end panel connected to the central panel by way of one of the lateral panels and defining the front wall of the container, all of which aligned along a first axis, also an appendage aligned with the central panel along a second axis perpendicular to the first axis, connected to the central panel and to form the lid, and in that the reinforcing frame is defined by predetermined portions of the end panel and at least one of the lateral panels; the wraper also comprising a plurality of cigarettes therein.

19. A wrapper as in claim 18, wherein the reinforcing frame is defined by predetermined portions of the end panel and each of the lateral panels, the reinforcing frame having an exposed portion greater in area than an overlapped portion, the end panel forming at least a portion of the front face.

* * * * *